United States Patent [19]

Sekiya et al.

[11] Patent Number: 4,567,694

[45] Date of Patent: Feb. 4, 1986

[54] GRINDING WHEEL FOR GRINDING THE FLAT SURFACE OF A HARD AND BRITTLE MATERIAL

[75] Inventors: Shinji Sekiya, Tokyo; Takatoshi Ono, Nagareyama, both of Japan

[73] Assignee: Disco Co., Ltd., Tokyo, Japan

[21] Appl. No.: 558,266

[22] Filed: Dec. 5, 1983

Related U.S. Application Data

[62] Division of Ser. No. 212,669, Dec. 3, 1980, Pat. No. 4,445,300.

[30] Foreign Application Priority Data

Feb. 1, 1980 [JP] Japan ..... 55-10887

[51] Int. Cl.[4] ..... B24D 5/10

[52] U.S. Cl. ..... 51/209 R; 51/266

[58] Field of Search ..... 51/206 R, 206 P, 209 R, 51/209 DL, 206.4, 359, 379, 382, 266

[56] References Cited

U.S. PATENT DOCUMENTS

| | | | |
|---|---|---|---|
| 1,544,459 | 10/1927 | Abbadessa . | |
| 2,626,489 | 1/1953 | Thompson . | |
| 2,811,960 | 11/1957 | Fessel | 51/206 R |
| 3,353,526 | 11/1967 | Daem et al. | 51/206 R |
| 3,587,554 | 6/1971 | Nelson | 51/206 R |
| 3,742,655 | 7/1973 | Oliver | 51/266 |
| 4,114,322 | 9/1978 | Greenspan | 51/206 R |
| 4,411,107 | 10/1983 | Sekiya et al. . | |

FOREIGN PATENT DOCUMENTS

| | | | |
|---|---|---|---|
| 950863 | 10/1949 | France . | |
| 0150088 | 12/1975 | Japan . | |
| 877573 | 9/1961 | United Kingdom . | |
| 1215064 | 12/1970 | United Kingdom | 51/206.4 |
| 0306011 | 8/1971 | U.S.S.R. | 51/206 R |

*Primary Examiner*—Frederick R. Schmidt
*Assistant Examiner*—Robert A. Rose
*Attorney, Agent, or Firm*—Flynn, Thiel, Boutell & Tanis

[57] ABSTRACT

Grinding of flat plates is performed by using a very thin, conical grinding wheel which is attached to the open end of a revolving cup and which projects outwardly from and is inclined with respect to the cup. The peripheral cutting edge of the grinding wheel revolving at high speed is brought into contact with the work. As the grinding wheel is fed, the work is cut by the grinding wheel across its thickness and an undercut part of the work disrupts (i.e. breaks off) by itself to a desired thickness. Thick grinding is also possible if a multiplicity of the grinding wheels are placed one over another at proper intervals.

16 Claims, 7 Drawing Figures

GRINDING WHEEL FOR GRINDING THE FLAT SURFACE OF A HARD AND BRITTLE MATERIAL

This is a division of application Ser. No. 212,669 filed Dec. 3, 1980, now U.S. Pat. No. 4,445,300.

BACKGROUND OF THE INVENTION

The present invention relates to a method for grinding a flat plate by the cutting action of a grinding wheel across the thickness of the plate.

Heretofore, grinding of flat surfaces of a hard, brittle work (1), like silicon and glass, has been accomplished by the use of a ring-shaped grinding wheel (2) attached to the lower open end of an inverted revolving cup (10) as shown in FIG. 1 (*a*). This conventional method has a drawback that grinding has to be repeated until the work is ground to a desired thickness. In other words, the conventional grinding wheel (2) having its side and bottom extending at right angles to each other grinds the work with both its side and bottom. In such a grinding mode, there is a great contact area that generates a large amount of friction heat thereby impairing the dimensional accuracy of the work due to thermal expansion, and loading of the pores of the grinding wheel with chips is likely to occur, resulting in dulling, burn marks, and grinding cracks. In addition, the cutting edge of the grinding wheel (2) becomes dull during grinding, causing the grindstone to lose proper contact with the work. This makes it difficult to grind the work with one pass, and makes it necessary to repeat the grinding bit by bit in order to grind the work to a desired thickness. In another type of conventional grinding wheel, the bottom is tapered inwardly as shown in FIG. 1 (*b*). This grinding wheel still has a large contact area and easily loses its sharpness, thereby making it necessary to regenerate the taper.

BRIEF SUMMARY OF THE INVENTION

It is an object of this invention to provide a method for grinding hard, brittle flat plates easily and accurately to a desired thickness, by the use of a thin grinding wheel which extends at a certain angle with respect to the surface to be ground. That part of the work to be removed by grinding is undercut by the grinding wheel and the undercut part disrupts, or breaks off, by itself into coarse chips. Thus, only the surface is ground by the grinding wheel. Unlike conventional methods, the grinding method according to this invention gives off coarse chips and a small quantity of fine powder. Grinding according to the method of this invention generates very little friction heat, minimizing burn marks, grinding cracks, and loss of dimensional accuracy due to thermal expansion.

The other objects and advantages of this invention will be apparent from the description that follows.

BRIEF DESCRIPTION OF THE INVENTION

FIGS. 1(*a*) and 1(*b*) are sectional views showing conventional grinding methods.

DETAILED DESCRIPTION OF THE INVENTION

Figure 1A:
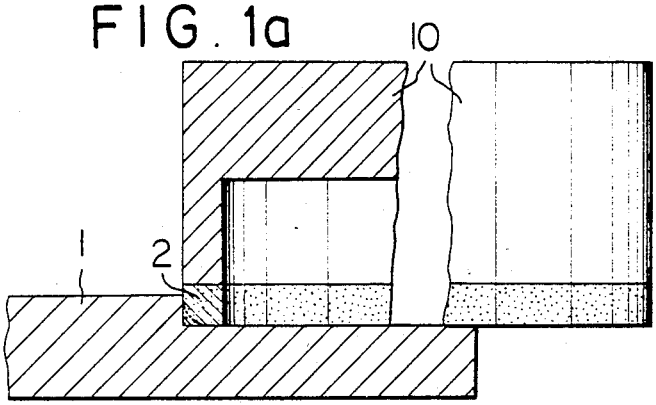
PRIOR ART FIG. 1a
Figure 1B:
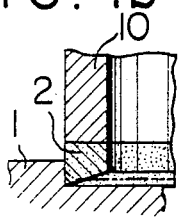
PRIOR ART FIG. 1b

The invention will be described into detail referring to the embodiments illustrated in the drawings.

Figure 2:
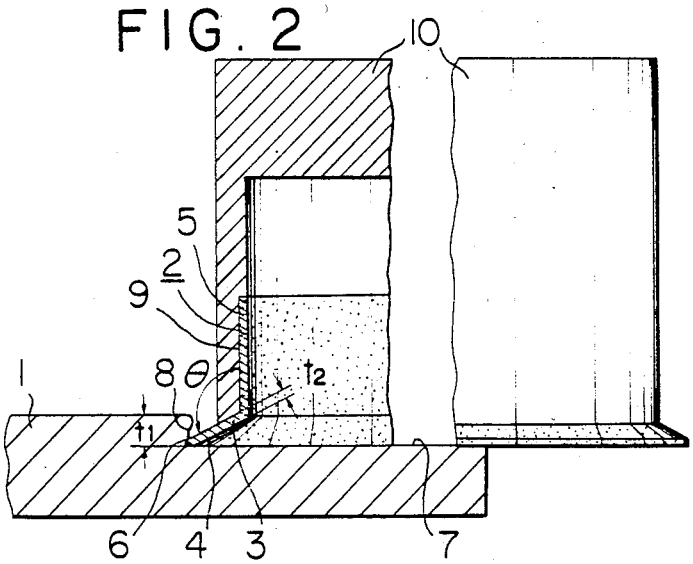
FIG. 2 is a sectional view showing an embodiment of the grinding method according to this invention.

In FIG. 2 showing grinding according to the method of this invention, the work (1) is hard, brittle silicon, glass, and the like which is easy to break with only a slight pressure. The thin grinding wheel (2) to grind the work (1) is formed by electrodeposition of super hard abrasive grains (super hard crystalline materials such as diamond grains and cubic system boron nitride). The grinding wheel is a cylinder with its lower end, or skirt, expanded outward aslant. The edge portion of the expanded part is the grinding part (3), which is 0.1 to 0.5 mm thick and about 5 mm wide. The bottom (4) of such edge portion is inclined 10° to 45° with respect to the grinding surface (7), or the angle ($\theta$) held between the fitting part (5) and the grinding part (3) is 100° to 135°, so that the bottom (4) does not come into contact with the grinding surface (7) of the work (1). Thus, the cutting edge (6) comes into contact with the cutting face (8) of the work (1) with a minimum of area. The said vertical fitting part (5) is firmly fixed, by bonding and the like, to the stepped part (9) inside the inverted cup (10).

The grinding stone (2) thus constructed accomplishes grinding based on the principle of cutting. The grinding wheel (2) is rotated at high speed together with the cup (10), and the grinding wheel (2) is advanced or the work (1) is moved. The relative position of the grinding wheel (2) and the work (1) is so adjusted that the grinding thickness ($t_1$) is 0.3 to 0.8 mm, several times the thickness ($t_2$) of the grinding wheel (2). Grinding is started with the edge (6) in contact with the side of the work (1), and then the grinding wheel (2) or the work (2) is moved at a predetermined speed. It should be noted that grinding is accomplished in such a manner that only the edge (6) of the grinding wheel (2) is in contact with the cutting face (8) and the undercut portion of the work (1) above the grinding part (3) disrupts by itself due to its brittleness. In other words, the portion of the work above the cutting face (8) is not actually ground, but disrupts by itself, and the grinding surface (7) is ground neatly by the grinding wheel (2). Thus, coarse chips and a small quantity of fine powder are given off as the result of grinding.

Figure 3:
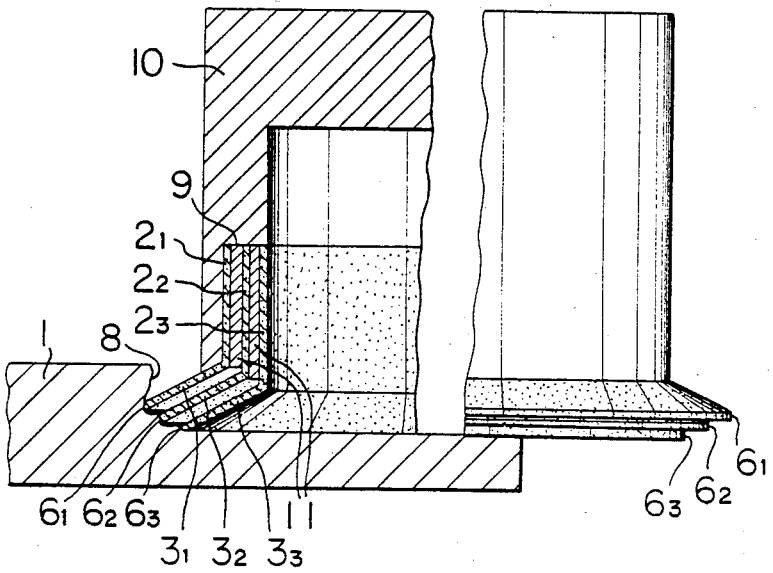
FIG. 3 is a sectional view showing another embodiment of the grinding method according to this invention.

FIG. 3 shows another embodiment to grind the work (1) to a greater depth with a single pass. In this embodiment, three grinding wheels ($2_1$), ($2_2$), and ($2_3$) having slightly different diameters are attached to the stepped part (9) inside the cup (10). The fitting part (5) of the grinding wheel ($2_1$) of the largest diameter is fastened to the stepped part (9) inside the cup (10). The grinding wheel ($2_2$) of middle diameter is fastened through the spacer (11) to the inside of the fitting part (5). Finally, the grinding wheel ($2_3$) of the smallest diameter is fastened through the spacer (11) in the same manner. Thus the grinding part (3) is arranged in three layers and the cutting edges ($6_1$), ($6_2$), and ($6_3$) having different diameters are arranged at certain intervals.

With the construction mentioned as above, grinding of the work (1) to a greater depth can be accomplished with a single pass because those portions which are undercut by the cutting edges ($6_1$), ($6_2$), and ($6_3$) of the respective grinding wheel ($2_1$), ($2_2$), and ($2_3$) disrupt by themselves as mentioned above.

Figure 4:
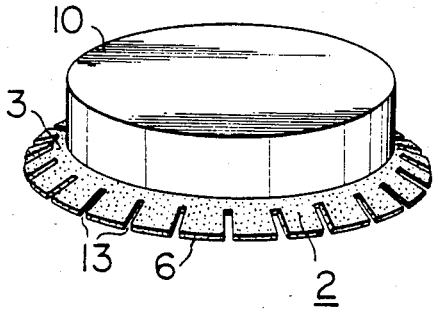
FIG. 4 is a perspective view of a slotted grinding wheel for another embodiment.
Figure 5:
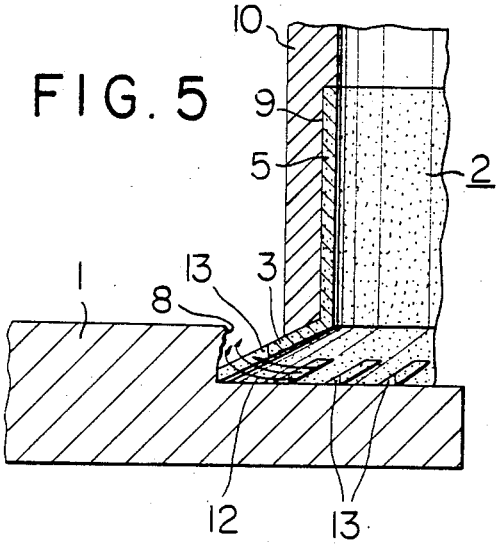
FIG. 5 is a sectional view of the embodiment of FIG. 4 showing the manner in which the slotted grinding wheel is cooled with water.

In another embodiment as shown in FIG. 4, the grinding wheel (2) is provided with slots (13) through which injected cooling water (12) and chips pass. The slots (13) extend from the cutting edge (6) to the middle of the grinding part (3). The use of the slotted grinding wheel prevents pores from loading with chips, keeping the sharpness. In addition, the cooling water (12) injected from the inside of the grindstone (2) reaches the cutting face (8) through the slot (13) to remove chips and cool the work (1) and the grinding wheel (2). The thinner and the more the slots (13), the more effective; but the depth, width, and number of the slots should be determined according to the object so that necessary strength is retained.

Figure 6:
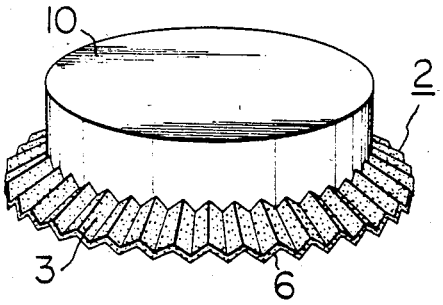
FIG. 6 is a perspective view of a grinding wheel for another embodiment of this invention.

FIG. 6 shows another embodiment of grinding wheel according to the invention which is free from loading and has high strength. The grinding part (3) of the grinding wheel (2) has a wavy form as viewed from side. The more and finer the wave forms, the more desirable. The wave may be either sharp triangular or sinusoidal curve. Also, for the same object, small holes 0.1 to 0.2 mm may be formed by electrospark machining on the grinding part (3).

What is claimed is:

1. In combination; a hard and brittle material workpiece and a grinding wheel for undercutting and disrupting the part of said hard and brittle material workpiece to be removed and simultaneously grinding the workpiece surface revealed by the undercutting, said grinding wheel comprising a cup rotatable about an axis substantially perpendicular to the flat surface to be ground and at least one annular grindstone attached to the open end of said cup for rotation therewith, said grindstone having a means for undercutting and therewith disrupting the part to be removed of a hard and brittle material workpiece and simultaneously grinding the workpiece surface revealed by the undercutting, said means being a thin grinding portion of said grindstone, said grinding portion protruding radially outwardly away in a separate manner from the open end of said cup with inclination relative to said axis and having a means for rigidifying of said grinding portion, said means comprising a circumferentially repeating wavy cross-sectional profile as seen looking edgewise of said grinding portion from its outer peripheral edge along said inclination toward said axis such that said grinding portion appears as a series of circumferentially repeated ridges and valleys radiating from said cup at said inclination, said grinding wheel being adapted to be positioned so that the outer peripheral edge of said grinding portion can interfere with the flat surface to be ground, with the hard and brittle material workpiece and said grinding wheel being moved relative to each other in a direction substantially parallel to the flat surface to be ground whereby the flat surface is ground in a cutting manner, said grindstone being a self-supporting thin shell of electrodeposited upper abrasive material adapted for grinding of silicon workpieces, said shell having thin radially inner and outer peripheral edges defining the thickness of the shell and connected by substantially wider interior and exterior width surfaces extending along said inclination, said shell consisting of a radially inner part fixed at one of said substantially wider width surfaces to said cup and a radially outer part cantilevering outward from said cup and being said grinding portion of said grindstone, said grinding portion having a thickness in the range of only about 0.1 mm to 0.5 mm and a width along said inclination from said cup outward to its peripheral edge about an order of magnitude greater than at least the smaller end of said range, said thickness being substantially constant along said inclination, whereby to minimize surface area of grinding contact with the workpiece and thereby minimize dulling of the grinding portion and consequent frictional heating and structural degradation of the workpiece.

2. The grinding wheel of claim 1 including circumferentially spaced blind slots extending from said outer peripheral edge partway into said grindstone.

3. A grinding wheel for grinding a flat surface of a hard and brittle material comprising a cup and at least one grindstone provided at an open end of said cup, said grindstone having an annular grinding portion which protrudes radially outwardly from the open end of said cup with inclination relative to the central axis of said cup, a substantial fraction of the width of said grindstone being cantilevered out from said cup, such that the radially inner and outer portions of the width of said grindstone are respectively backed by and free of backing by said cup, said grindstone being of electrodeposited super hard abrasive grains with at least said radially outer portion of the width of said grindstone not including any substrate or other backing, said grinding portion having a wavy form as seen looking edgewise thereat, the thickness of said grinding portion being in the range of 0.1 to about 0.5 mm, whereby said grinding portion is sufficiently thin to grind the flat surface in a cutting manner efficiently and accurately.

4. The grinding wheel of claim 3 wherein said grinding portion is corrugated, the corrugations providing said wavy forms, said corrugations being arranged side-by-side circumferentially of the grinding portion having peaks and troughs whose lengths radiate away from the open end of the cup.

5. The grinding wheel of claim 4 wherein the cross-sectional form of said corrugations is a sharp triangular form.

6. The grinding wheel of claim 4 wherein the cross-sectional form of said corrugations is a sinusoidal form.

7. The grinding wheel of claim 3 wherein said super hard abrasive grains are diamond abrasive grains.

8. The grinding wheel of claim 3 wherein the angle ($\theta$) between said grinding portion and said central axis is at least 100°.

9. The grinding wheel of claim 3 wherein the hard and brittle material is silicon.

10. A grinding wheel for grinding the flat surface of a hard and brittle material, comprising:

a cup rotatable about an axis substantially perpendicular to the flat surface to be ground and having a downward facing open end; and an annular grindstone, said grindstone being a thin open-center conical skirt of thickness in the range of about 0.1 to about 0.5 mm, said grindstone protruding downwardly and radially outwardly away from the open end of said cup at an inclination to said axis, the downward facing open end of said cup having an annular surface shaped in conformance to the radially inner part of the width of said grindstone and to which only the radially inner part of the width surface of the grindstone is affixed to fixedly depend the grindstone from the open end of the cup, the thickness of the grindstone being substantially less than its width along its inclination and than its circumference, at least a substantial portion of the inclined width of said grindstone being cantilevered out from said cup, such that the radially inner and outer portions of the width of grindstone are respectively backed by and free of backing by said cup, said grinding wheel being positioned so that the outer peripheral edge of said grindstone interferes with the flat surface to be ground, the hard and brittle material and said grinding wheel being adapted to be relatively movable in a direction substantially parallel to the flat surface to be ground whereby the flat surface is ground in a cutting manner, said grinding portion having a wavy form as seen looking edgewise thereat.

11. The grinding wheel of claim 10 wherein said grindstone is a self-supporting thin annular shell of electrodeposited super abrasive grains, said shell consisting of said radially inner and outer portions, said shell radially inner portion being fixed to and carried by said cup, said shell radially outer portion cantilevering outward from said cup.

12. The grinding wheel of claim 11 wherein said super abrasive grains are of diamond abrasive.

13. The grinding wheel of claim 11 wherein said super abrasive grains are of cubic system boron nitride abrasive.

14. The grinding wheel of claim 10 wherein the hard and brittle material is any one of silicon and glass.

15. A grinding wheel for grinding the flat surface of a hard and brittle material, comprising:

a cup rotatable about an axis substantially perpendicular to the flat surface to be ground and having a downward facing open end; and a one-piece annular grindstone, said grindstone being a thin open-center conical skirt of thickness in the range of about 0.1 to about 0.5 mm, said grindstone protruding downwardly and radially outwardly away from the open end of said cup at an inclination to said axis, the downward facing open end of said cup having an annular surface inclined in conformance to the inclination of said grindstone and to which the radially inner part of the upper width surface of the grindstone is affixed to fixedly depend the grindstone from the open end of the cup, the thickness of the grindstone being substantially less than its width along its inclination and than its circumference, a substantial portion of the inclined width of said grindstone being cantilevered out from said cup, such that the radially inner and outer portions of the width of grindstone are respectively backed by and free of backing by said cup, said grinding wheel being positioned so that the outer peripheral edge of said grindstone interferes with the flat surface to be ground, the hard and brittle material and said grinding wheel being adapted to be relatively movable in a direction substantially parallel to the flat surface to be ground whereby the flat surface is ground in a cutting manner, said grinding portion having a wavy form as seen looking edgewise thereat.

16. The grinding wheel of claim 15 wherein said grindstone is a selfsupporting thin annular shell of electrodeposited super hard abrasive grains.

* * * * *